US007846072B1

(12) United States Patent
Bellerive

(10) Patent No.: US 7,846,072 B1
(45) **Date of Patent: *Dec. 7, 2010**

(54) MULTIPLE PART POLE FOR A SWIMMING EXERCISING DEVICE

(76) Inventor: Donald Bellerive, 10711 Deer Run Farms Rd., Fort Myers, FL (US) 33966

( * ) Notice: Subject to any disclaimer, the term of this patent is extended or adjusted under 35 U.S.C. 154(b) by 0 days.

This patent is subject to a terminal disclaimer.

(21) Appl. No.: 12/460,484

(22) Filed: Jul. 20, 2009

Related U.S. Application Data

(63) Continuation-in-part of application No. 12/008,314, filed on Jan. 10, 2008, now Pat. No. 7,563,206.

(51) Int. Cl.
*A63B 31/00* (2006.01)

(52) U.S. Cl. ..... 482/55; 434/254

(58) Field of Classification Search ..... 482/55, 482/56; 434/254; 43/21.2; 403/292, 296; 248/518, 535, 538
See application file for complete search history.

(56) References Cited

U.S. PATENT DOCUMENTS 3,368,271 A * 2/1968 Scheffler ..... 29/411
3,609,906 A * 10/1971 Johnson ..... 43/18.5
3,830,008 A * 8/1974 Johnson ..... 43/18.1 CT
3,981,500 A * 9/1976 Ryan ..... 248/274.1
4,007,646 A * 2/1977 De Jonge ..... 74/501.6
4,530,497 A * 7/1985 Moran et al. ..... 482/55
5,303,931 A * 4/1994 Brown ..... 273/348
5,711,331 A * 1/1998 Harris ..... 135/16
7,264,556 B1 * 9/2007 Divisconti ..... 473/296
7,442,151 B1 * 10/2008 Berdegue ..... 482/55
7,458,902 B2 * 12/2008 Gill ..... 473/299
7,563,206 B1 * 7/2009 Bellerive ..... 482/55
2005/0223617 A1 * 10/2005 Morita et al. ..... 43/18.5
2005/0227776 A1 * 10/2005 Benson ..... 473/239

* cited by examiner

*Primary Examiner*—Nicholas D Lucchesi
*Assistant Examiner*—Tam Nguyen

(57) ABSTRACT

Individual swimmers may routinely and easily perform exercise regiments to maintain or enhance their general health and fitness utilizing the present invention. Multiple part poles may be readily shipped, or otherwise transported, in a disassembled state and assembled easily and quickly to full length for use with the overall swimming exercise device. Various configurations of sections and connections are disclosed. Ideally a taper will exist where the deployed multiple part pole will flex more toward an outer end of the multiple part pole.

18 Claims, 6 Drawing Sheets

MULTIPLE PART POLE FOR A SWIMMING EXERCISING DEVICE

CROSS-REFERENCE

This application is a continuation-in-part of serial no.: 12/008,314 filed Jan. 10, 2008 and entitled "Swimming Exercising Device", now U.S. Pat. No. 7,563,206. The original application is incorporated herein by this reference.

BACKGROUND

1. Field of the Invention

Generally, the invention relates to exercise devices which permit a swimmer to be retained in a generally stationary position within a body of water, such as a swimming pool, during performance of a conventional swimming action. More specifically, the invention relates to multiple part poles of such exercise devices.

2. Description of the Prior Art

Numerous methods exist to exercise portions of the human body. Certain devices have been proposed which provide for the person performing the associated exercise to be in water. It has long been known that swimming is one of the very best forms of exercise. Many types of 'strokes', or swimming styles, are known in conventional swimming. Some of these utilize movement and exertion of the arms more than that of the legs. Some of these utilize movement and exertion of the legs more than that of the arms. Some of these utilize movement and exertion of both the arms and legs. During swimming, even through the arms and legs may appear to be performing most of the action, many muscles of the body are utilized. Therefore, a full body workout can be obtained by swimming for a reasonable period of time.

Swimming is considered by many in the medical and physical fitness fields as a nearly perfect exercise for nearly all persons regardless of age or general physical condition. Unlike running, or even walking, there is no impact delivered to the feet and legs, including all of the joints contained therein, during swimming. Additionally, many styles of swimming simultaneously exercise both the arms and legs during performance of the respective swimming action. Certain land based exercise routines, such as jumping jacks, exercise, both the arms and legs simultaneously but typically such exercises due not provide desirable resistance to the limbs during performance of the exercise. Water is the ideal medium for exercise due to the nature of the water and the natural resistance to motion of objects through water. During swimming the swimmer may merely increase their speed of completing each cycle of a stroke to increase the resistance of the exercise. Additionally, during swimming it is easy to change from one selected style of swimming to another style of swimming to vary the workout routine.

The fundamental problem with swimming as an exercise involves the fact that most Americans which routinely swim as an exercise do so in a swimming pool. Therefore, the swimmer will swim from one end of the pool to the opposing end, then turn one hundred and eighty (180) degrees and swim back to the then opposing end. This cycle will then be performed repetitively for the duration of the exercise routine. This constant contact with, or at least approach to, the hard perimeters of the opposing ends of the pool have obvious inherent dangers. Many swimming styles have the swimmer's face down into the water which is raised out of the water to breath and to look forward, if desired. Other swimming styles have the swimmer's face facing upward toward the sky, such as during performance of the backstroke. For these reasons it is difficult for the swimmer to constantly remain aware of their spacial orientation with the perimeter of the pool that they are approaching during movement from one end to the opposing end. Many swimming pools, particularly those associated with a individual home, are relatively small. Additionally, some swimming styles require a depth of water greater than that of the shallow end of some swimming pools. Often the swimmer desiring to perform their exercise routine in a swimming pool will have other swimmers utilizing the swimming pool for their own recreational use. For all of these reasons many persons having access to a swimming pool will not utilize the pool to the fullest extent possible for exercise.

Applicant previously developed and patented, U.S. Pat. No. 4,530,497 issued Jul. 23, 1985, an exercising device which provides many of the benefits of stationary swimming exercise. Applicant has been successfully marketing products based upon applicant's earlier invention for many years. Applicant has recently made numerous improvements to his product line which are the subject matter of the present invention.

Various deficiencies exist with nearly all forms of exercise and devices to facilitate each respective form of exercise. Applicant's previous invention, and products based upon that invention, provide for the optimal exercise routine in an extremely safe manner. Various minor disadvantages exist with applicant's prior invention and products based upon that invention. These minor disadvantages are particularly related to shipping and distribution of such products and transport and storage of such products by the end user. As such, it may be appreciated that there continues to be a need for a versatile and transportable swimming exercise device. The present invention substantially fulfills these needs.

SUMMARY

In view of the foregoing disadvantages inherent in the known types of exercise devices, your applicant has devised a swimming exercise device for a swimmer to allow generally free movement of legs and arms during performance of a swimming action by the swimmer within a body of water. The performance of the swimming action occurring while the swimmer is being restricted to a generally stationary position in the body of water. The swimming exercise device has a multiple part pole, means to retain the multiple part pole, an engagement member and a connection member. The multiple part pole has at least two pole sections and at least one connection between the pole sections. The multiple part pole has a securing end, an outer end and a resilient flexibility along a portion of the multiple part pole at least near the outer end. The connection between the pole sections of the multiple part pole is a securement coupling having a first threaded member and a second threaded member. The pole sections associated with the connection join, and are securely retained in that orientation, utilizing the first threaded member of the securement coupling and the second threaded member of the securement coupling. The multiple part pole has a securing end, an outer end and a resilient flexibility along a portion of the multiple part pole at least near the outer end. The means to retain the multiple part pole provide for the securing end of the multiple part pole to be retained in a fixed position relative to the body of water. The engagement member contacts the swimmer while leaving the swimmer free to manipulate their legs and arms during performance of the swimming action. The connection member has a first end and a second end. The first end of the connection member is secured relative to the outer end of the multiple part pole. The second end of the connection member is secured relative to the engagement member. This combination of the multiple part pole, the engagement member and the connection member cooperate to provide for a restriction of placement of the swimmer in the body of water during the performance of the swimming action while further providing for a lifting action to the swimmer while in the body of water during the performance of the swimming action.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for an exercise device which will retain a swimmer in a swimming pool in a generally stationary placement where the swimmer will exercise utilizing any desired swimming stroke for any desired duration of time.

Other objects include;

a) to provide for a lifting action to be exerted on the generally stationary swimmer where the stationary swimmer has a sensation generally equaling that obtained during movement through the water during conventional swimming.

b) to provide for a flexing of a multiple part pole tethering the swimmer where the stationary swimmer does not experience any sudden or unnatural restraining pressure during each stoke of a series of strokes during performance of the swimming action.

c) to provide for the multiple part pole of the swimming exercise device to be formed of multiple parts which may be separated where transport of the swimming exercise device may occur in shipping or transport containers which do not have excessive length.

d) to provide for an angular offset of portions of the multiple part pole.

e) to provide for the multiple part pole to be formed of two portions and one connection.

f) to provide for the multiple part pole to be formed of three portions and two connections.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
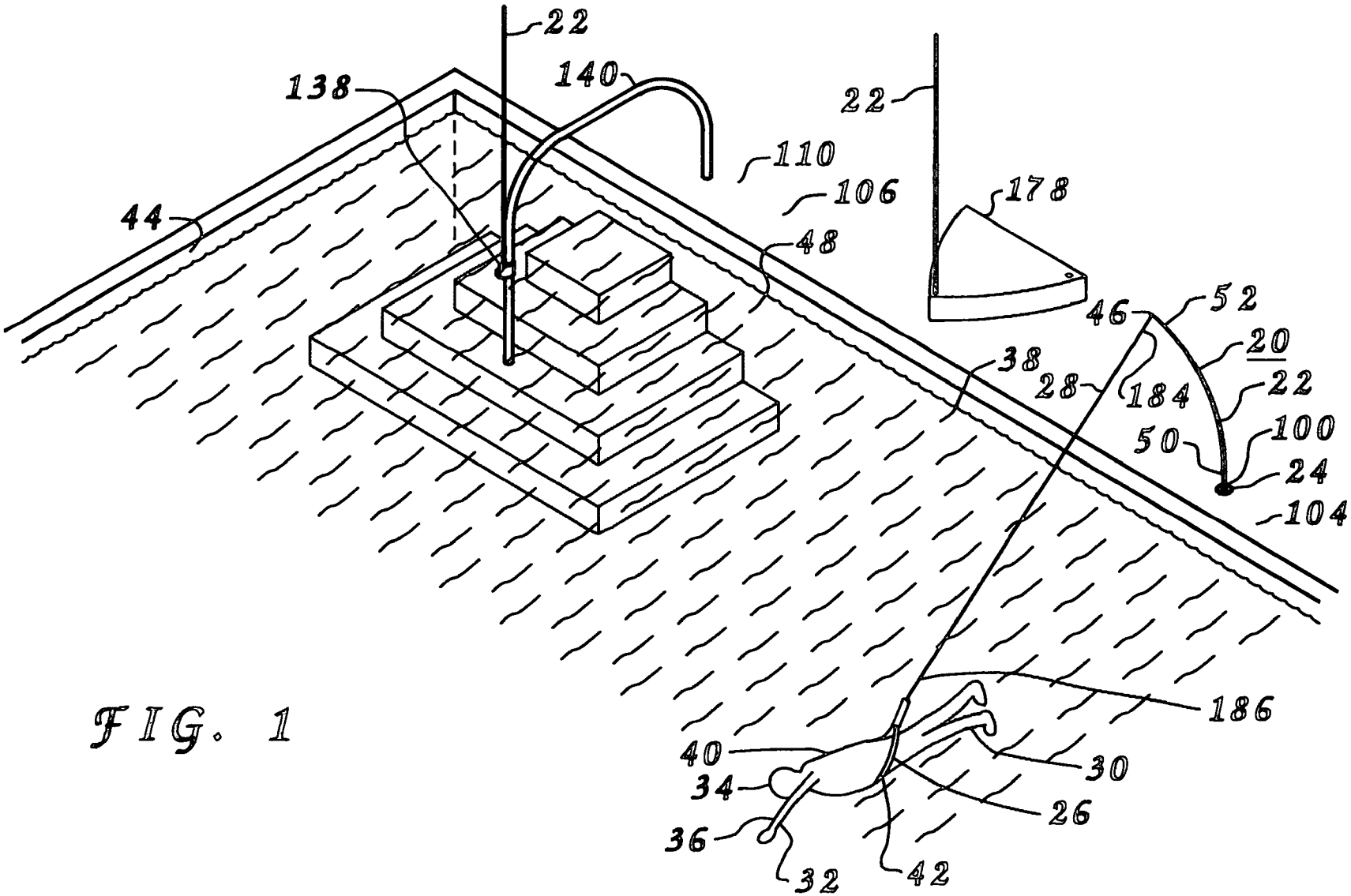
FIG. 1 is a perspective view of a body of water have three (3) swimming exercise devices of the present invention positioned thereabout.
Figure 2:
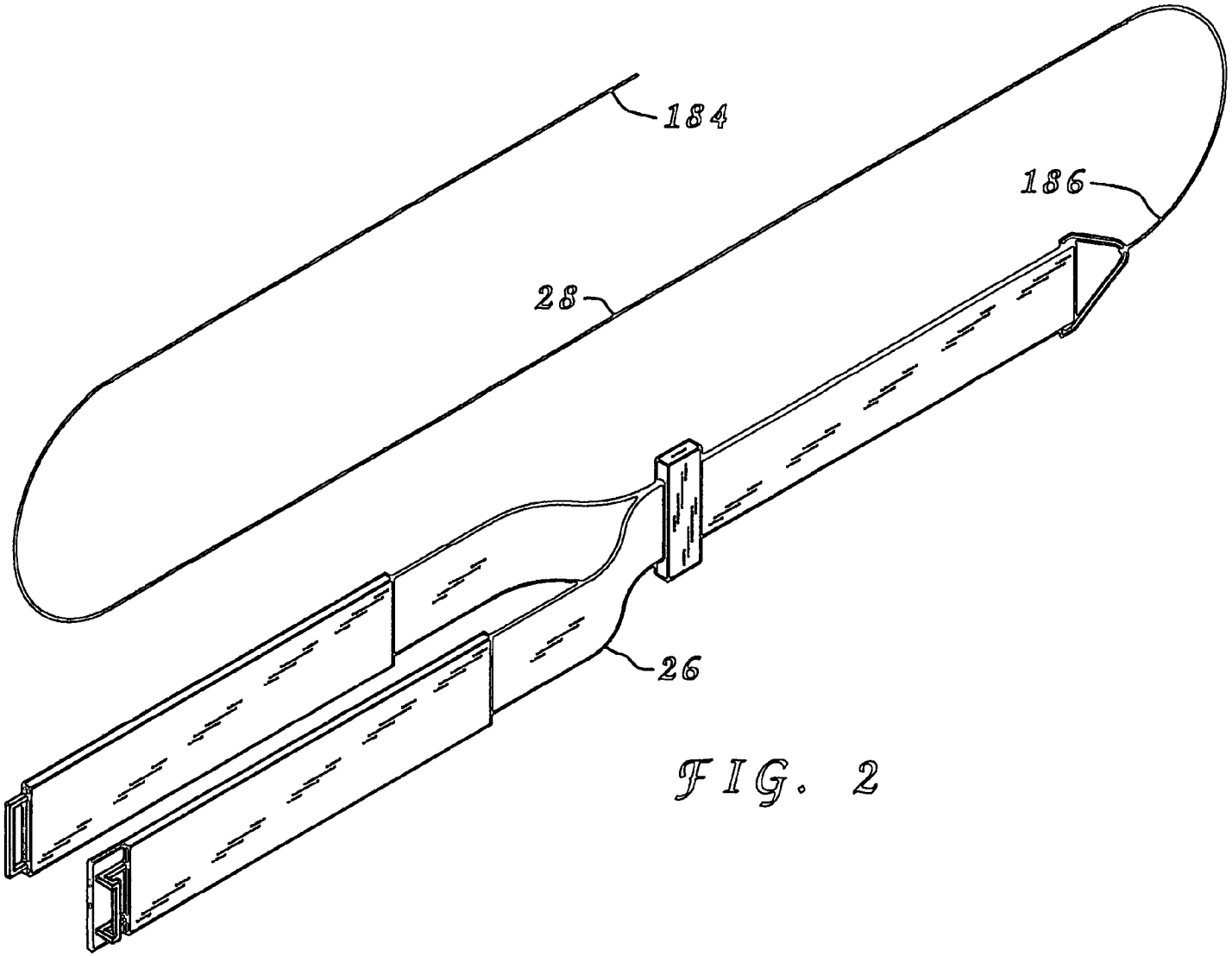
FIG. 2 is a perspective view of an engagement member and a connection member of the swimming exercise device.

Many different systems having features of the present invention are possible. The following description describes the preferred embodiment of select features of those systems and various combinations thereof. These features may be deployed in various combinations to arrive at various desired working configurations of systems.

Reference is hereafter made to the drawings where like reference numerals refer to like parts throughout the various views.

The present invention provides for a person to perform a swimming based exercise in a generally stationary position within a body of water while experiencing all of the benefits of free movement swimming. In order to provide these benefits structural components cooperate to perform various required functions. The required functions include placement restriction, lifting action and resilient motion. Numerous structural arrangements are available to perform each of these functions and may be deployed in various combinations. An anchoring of the multiple part pole relative to the body of water, in combination with other structural components, provides for the desired placement restriction of the swimmer within the body of water. The lifting action provides the swimmer with the sensation of free swimming while being retained in a generally fixed location within the body of water. During performance of the swimming action the swimmer will be making the strokes associated with a specific swimming style in a repetitive manner. It being understood that many swimming styles may be utilized with the present invention. During performance of each stroke for any respective swimming style, as is true for conventional free swimming, various degrees of forward force will be applied by the swimmer within the water during a specific point within each of the strokes. During conventional free swimming these variations in propulsion force within each repetitive cycle of strokes would have no noticeable effect upon the swimmer. When the strokes are performed in a tethered manner it is desirable to provide for a certain degree of resilient motion at some location within the tether assembly to maintain a generally uniform pressure between the swimmer and the components of the assembly contacting the swimmer. While this resilient motion may be accommodated within various of the components, or even a combination of components, it has been discovered that the best component to provide this feature is the multiple part pole. Additionally, it has been discovered that it is best to restrict this flex of the multiple part pole to the uppermost portion of the multiple part pole. This is accomplished in the preferred embodiment by providing a taper to the multiple part pole, as is conventionally known in fishing poles, where a diminishing of diametric measurement along the length of the multiple part pole restricts the flex to the outermost extent of the multiple part pole. Of course, if desired, it is possible to provide certain portions of the multiple part pole to have a uniform diametric measurement rather than having a taper along the entire length of the multiple part pole.

FIG. 1 depicts a swimming exercise device 20 having a multiple part pole 22, means to retain multiple part pole 22, in the form of a pole mount 24, an engagement member 26 and a connection member 28. Swimming exercise device 20 functions to allow a generally free movement of legs 30 and arms 32 of a swimmer 34 during performance of a swimming action 36 by swimmer 34 within a body of water 38 while swimmer 34 is being restricted to a generally stationary position 40 in body of water 38.

Multiple part pole 22, engagement member 26 and connection member 28 cooperate to provide for restriction of placement of swimmer 34 in body of water 38 during performance of swimming action 36 while further providing for a lifting action 42 to swimmer 34 while in body of water 38 during performance of swimming action 36. The combination of location placement with the lifting action provides for an excellent exercise session which is extremely beneficial to overall health yet is both fun to perform and safe to perform.

The present invention provides for swimmer 34 to be retained in stationary position 40 within body of water 38, such as a swimming pool 44, while also providing a certain amount of lift within swimming pool 44 during performance of swimming action 36. To this end of providing for the retention in stationary position 40 multiple part pole 22 provides for securement to a fixed position relative to body of water 38. Multiple part pole 22 also provides for a certain amount of resilient motion, or flex, which is providing the resistance to swimmer 34 during performance of swimming action 36. To the end of providing the lift during performance of the swimming action it is necessary to provide for elevation of a connection point 46 of multiple part pole 22 for connection member 28 above a surface 48 of swimming pool 44.

A multiple part pole will be provided which will perform several important functions. The multiple part pole will provide for an attachment location for the connection member elevated well above the surface of the body of water. This elevated attachment location in combination with an angle of the connection member will provide the desired lifting action to the swimmer during performance of the swimming action. Additionally, a resilient flexibility of the multiple part pole will provide for resilient motion of swimmer 34 within swimming pool 44. Multiple part pole 22 has a securing end 50, an outer end 52 and a resilient flexibility along a portion of multiple part pole 22 at least near outer end 52. Preferably, multiple part pole 22 has a gradual and consistent taper, as depicted, from securing end 50 to outer end 52. Multiple part pole 22 may be constructed from many suitable materials.

Figure 3A:
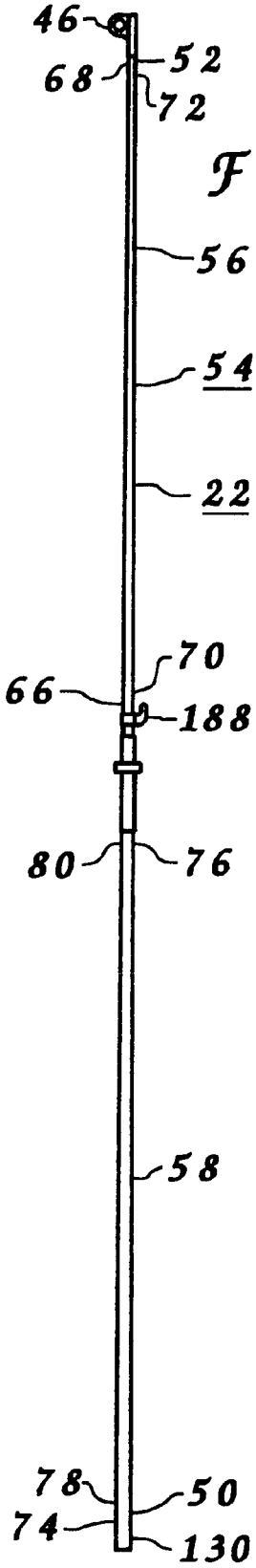
FIG. 3*a* and FIG. 3*b* are elevational views of a multiple part pole of the swimming exercise device in an assembled state and a disassembled state.
Figure 3B:
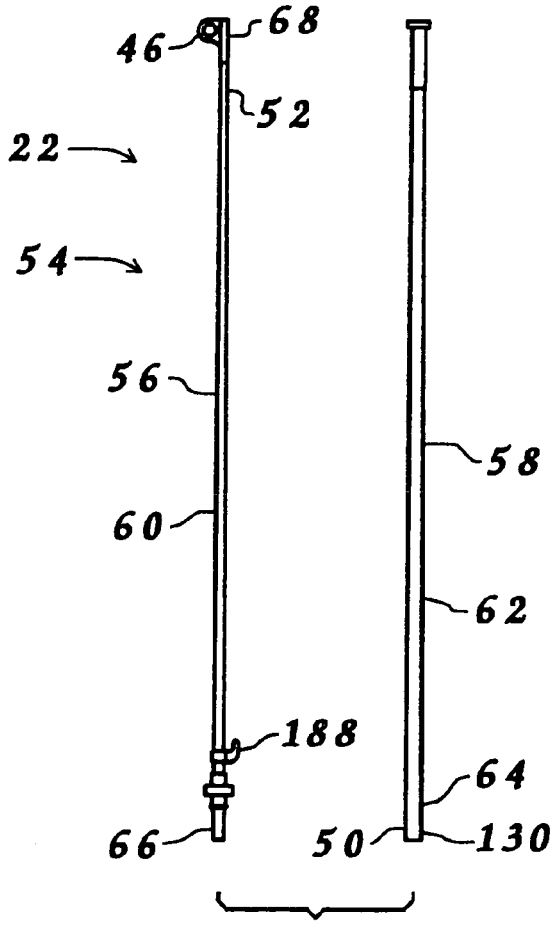
Figure 4A:
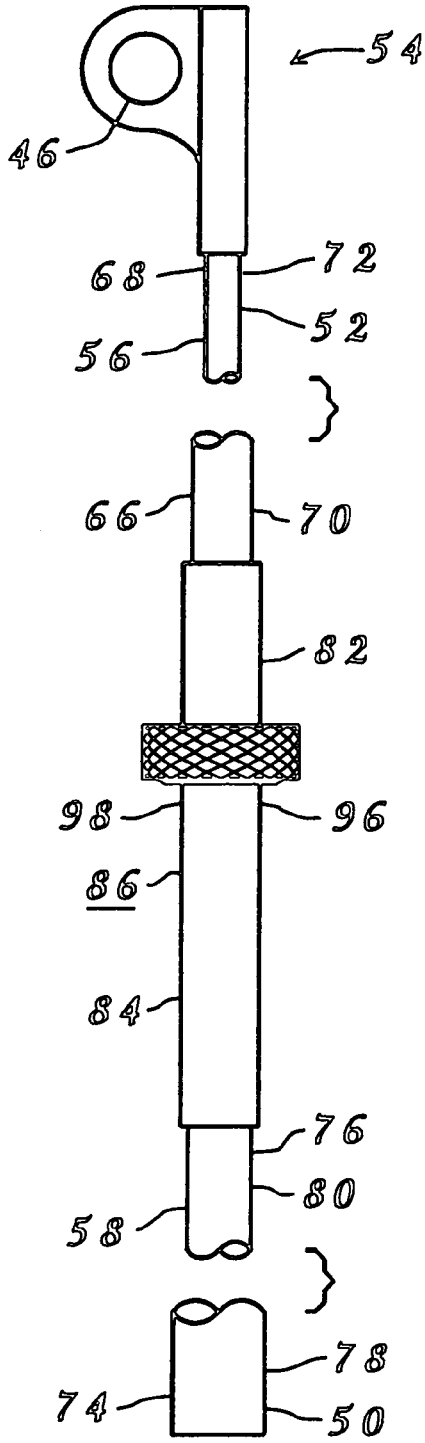
FIG. 4*a* and FIG. 4*b* are elevational view of enlarged portions of the components depicted in FIG. 3*a* and FIG. 3*b*.
Figure 4B:
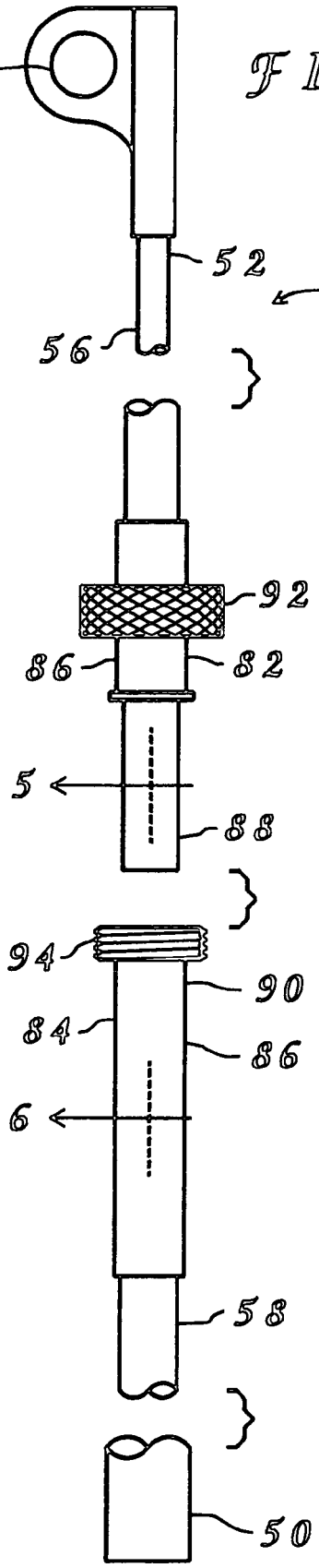
Figure 5:
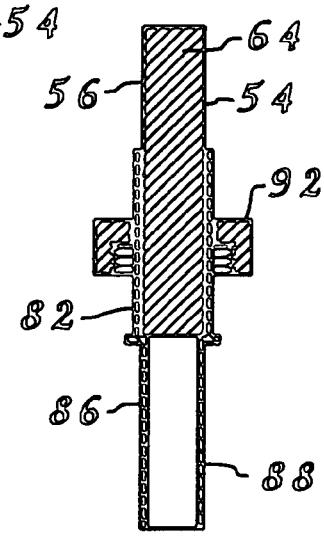
FIG. 5 is a sectional view of a portion of the assembly depicted in FIG. 4*b* as taken from the section line '5' shown in FIG. 4*b*.
Figure 6:
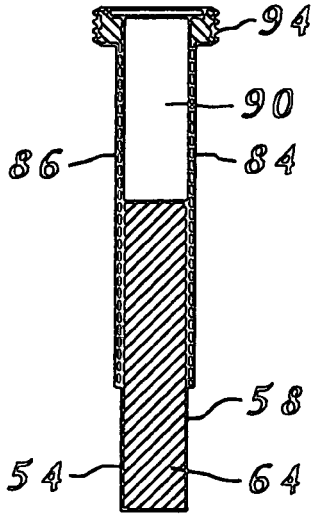
FIG. 6 is a sectional view of a portion of the assembly depicted in FIG. 4*b* as taken from the section line '6' shown in FIG. 4*b*.
Figure 7:
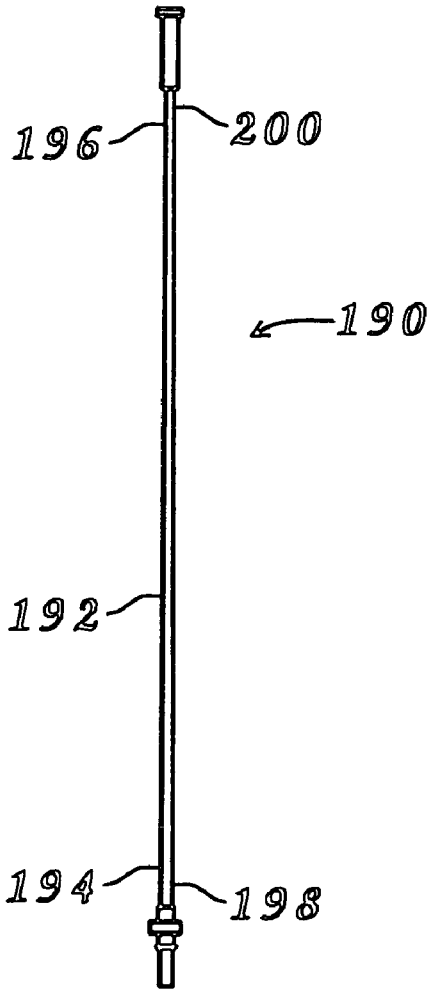
FIG. 7 is an elevational view of an intermediate portion of a multiple part pole.
Figure 8:
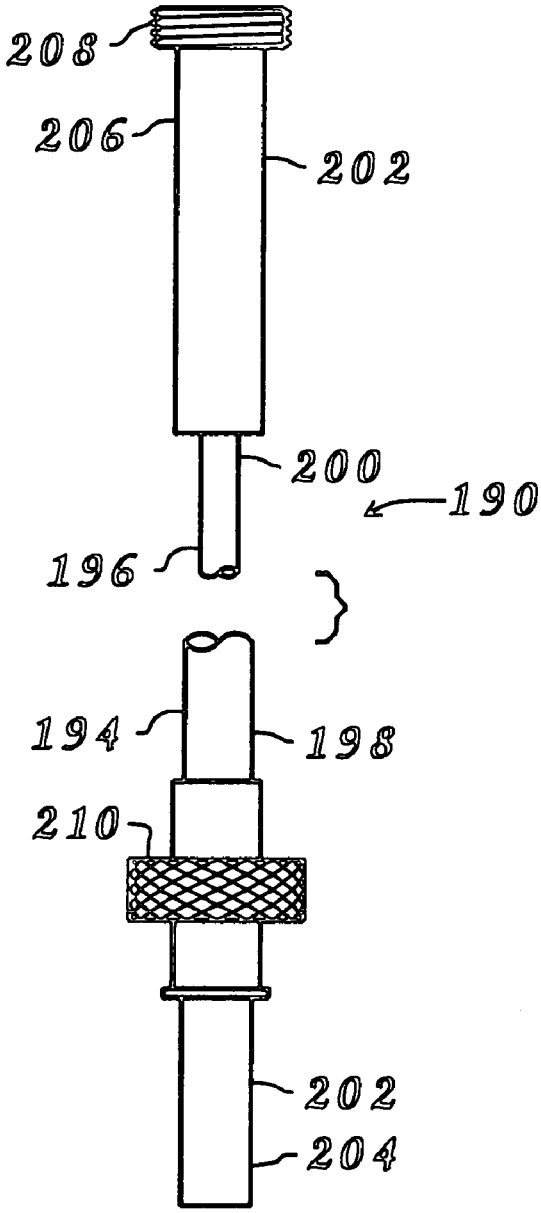
FIG. 8 is an elevational view of enlarged portions of the intermediate portion of the multiple part pole depicted in FIG. 7.

Multiple part pole 22 has at least two (2) portions which may be easily separated, see FIG. 3*a* and FIG. 4*b*, and easily attached, see FIG. 3*a* and FIG. 4*a*. FIG. 7 and FIG. 8 depict a third pole section, in the form of an intermediate portion 190, for use within multiple part pole 22. Referring again to FIG. 3*a* through FIG. 4*b*, multiple part pole 22 has a first portion 56 and a second portion 58. First portion 56 of multiple part pole 22 has a length measurement 60, see FIG. 3*b*, while second portion 58 of multiple part pole 22 has a length measurement 62, also see FIG. 3*b*. In the most preferred embodiment length measurement 60 of first portion 56 is generally equal to length measurement 62 of second portion 58. In a preferred embodiment first portion 56 is formed of a solid shaft material 64, see FIG. 5, and second portion 58 is formed of solid shaft material 64, see FIG. 6. Preferably, intermediate portion 190 is also formed of solid shaft material 64. Any number of sections desired may be utilized to form the multiple part pole and these may be of any desired respective lengths and diametric measurements and shapes. It is possible to provide for multiple part pole to remain together while in a storage or transport mode. This is easily provided for by utilizing a telescoping arrangement, as conventionally known in the art, or in a folding arrangements, also as conventionally known in the art. Intermediate portion 190 has a has a length measurement 192, see FIG. 7, which in the most preferred embodiment, is generally equal to length measurement 60 of first portion 56 and to length measurement 62 of second portion 58.

Referring now to FIG. 3*a* and FIG. 4*a* which depict a preferred embodiment, first portion 56 of multiple part pole 22 has a first end 66 and a second end 68. First end 66 of first portion 56 has a diametric measurement 70. Second end 68 of first portion 56 has a diametric measurement 72. Diametric measurement 70 of first end 66 of first portion 56 is greater than diametric measurement 72 of second end 68 of first portion 56. Second portion 58 of multiple part pole 22 has a first end 74 and a second end 76. First end 74 of second portion 58 has a diametric measurement 78. Second end 76 of second portion 58 has a diametric measurement 80. Diametric measurement 78 of first end 74 of second portion 58 is greater than diametric measurement 80 of second end 76 of second portion 58. Diametric measurement 70 of first end 66 of first portion 56 is generally equal to diametric measurement 80 of second end 76 of second portion 58.

Referring now to FIG. 7 and FIG. 8, intermediate portion 190 has a first end 194 and a second end 196. First end 194 of intermediate portion 190 has a diametric measurement 198. Second end 196 of intermediate portion 190 has a diametric measurement 200. Diametric measurement 198 of first end 194 of intermediate portion 190 is greater than diametric measurement 200 of second end 196 of intermediate portion 190. This tapering provides for intermediate portion 190 to have more flex near second end 196.

It is necessary to assemble and secure the various parts of the multiple part pole when the various sections are configured to be separated. Many coupling and securing methods are known in the art to provide this required function and many of these methods and structures may be utilized with the present invention. When the parts are detachable it is possible to provide for mere contact to retain the parts together, such as a simple penetration coupling. Alternatively, it is possible to provide for structures to securely retain the parts together. This retention can be as simple as a bayonet type coupling where a male part penetrates a female part and a rotational displacement locks the parts together. Alternatively, the retention can be more complicated such as the opposing threaded couplings depicted in various of the views.

FIG. 3*a* through FIG. 6 depict a preferred embodiment for this coupling and securing where first portion 56 of multiple part pole 22 has a pole coupling end 82 and second portion 58 of multiple part pole 22 has a pole coupling end 84. Multiple part pole 22 has a penetrate and securement coupling 86 having a male member 88, a female member 90, a first threaded member 92 and a second threaded member 94. Pole coupling end 82 of first portion 56 and pole coupling end 84 of second portion 58 slidably join utilizing male member 88 of penetrate and securement coupling 86 and female member 90 of penetrate and securement coupling 86 and are securely retained utilizing first threaded member 92 of penetrate and securement coupling 86 and second threaded member 94 of penetrate and securement coupling 86. Pole coupling end 82 of first portion 56 and pole coupling end 84 of second portion 58 are retained in an extremely close orientation 96 when penetrate and securement coupling 86 is in a secured orientation 98.

FIG. 7 and FIG. 8 depict intermediate portion 190 of multiple part pole 22 having opposing portions of penetrate and securement coupling 202 having a male member 204, a female member 206, a first threaded member 208 and a second threaded member 210. This arrangement provides for installation of intermediate portion 190 between first portion 56 and second portion 58.

Figures 9A, 9B:
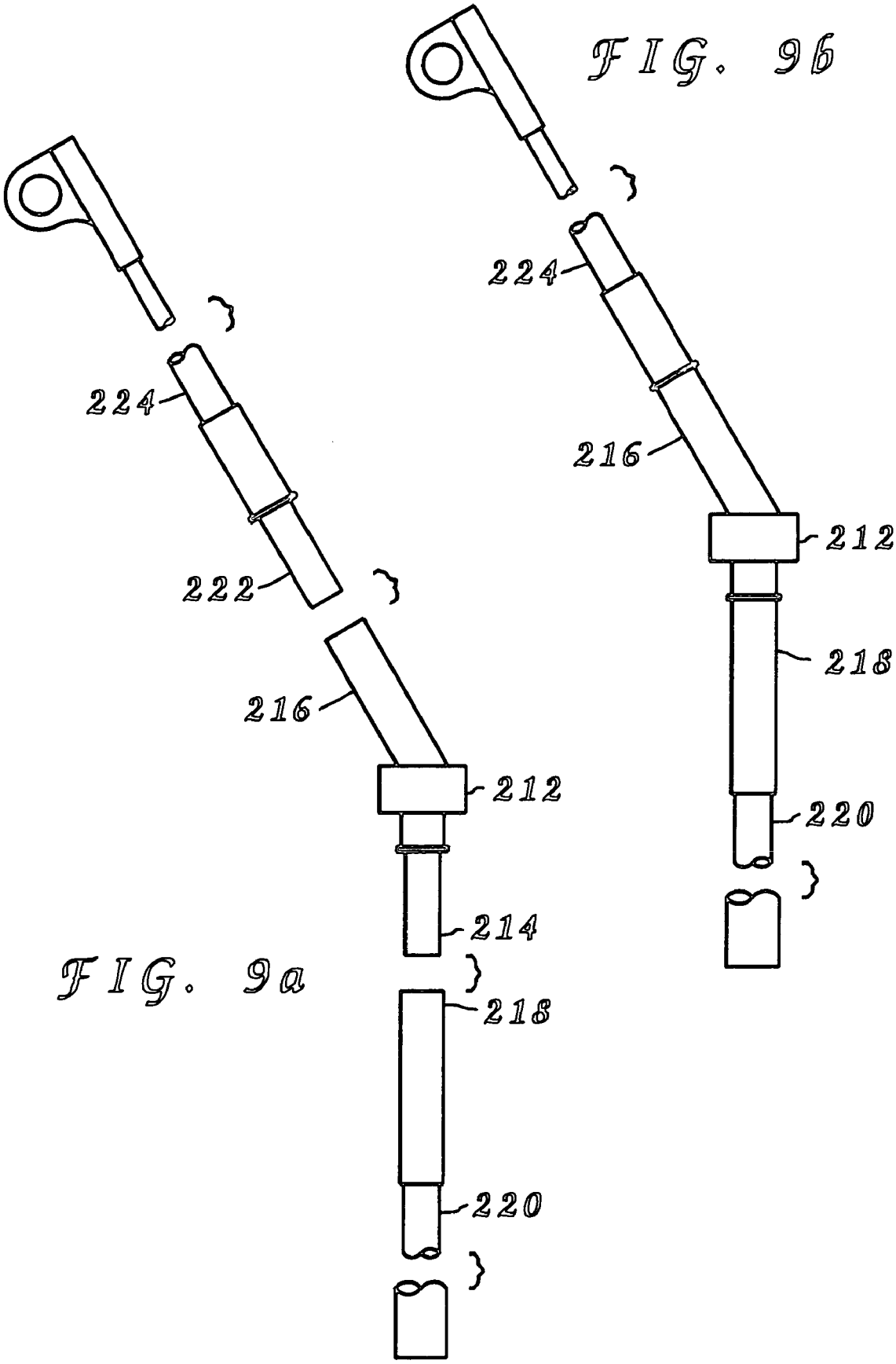
FIG. 9*a* and FIG. 9*b* are elevational view of an enlarged offset coupling, a lower pole portion and an upper pole portion in a disassembled orientation and in an assembled orientation respectively.

In certain situations it is desirable to provide for an angular change between portions of the multiple part pole. Various structures may be deployed to provide for the angular change. FIG. 9*a* and FIG. 9*b* depict an offset coupling 212 having a first coupling portion 214 and a second coupling portion 216 which are penetration type couplings. First coupling portion 214 slidingly receives a second coupling portion 218 of a lower pole portion 220. Second coupling portion 216 slidingly receives a first coupling portion 222 of an upper pole portion 224. In the absence of use of offset coupling 212 second coupling portion 218 of lower pole portion 220 may mate with first coupling portion 222 of upper pole portion 224.

It is a requirement that some arrangement be provided to retain the securing end of the multiple part pole relative to the body of water. This may be provided by merely utilizing existing structures about the body of water or, more preferably, will involve providing dedicated structural components which will be fixedly secured, at least temporarily, about the body of water.

It is possible to provide for at least the multiple part pole of the present invention to remain generally permanently positioned relative to the body of water even when not being utilized for performance of the swimming action. More preferably, the multiple part pole will be removed when not being utilized for performance of the swimming action. To this end it is desirable that the multiple part pole be slidably insertable and removeable relative to a pole mount. Many variations of pole mounts are possible with various embodiments depicted in the various views.

An engagement member will be provided to contact the swimmer while leaving the swimmer free to manipulate their legs and arms during performance of the swimming action. This may involve mere surrounding contact of the torso of the swimmer, as depicted in FIG. 1 by engagement member 26, or may involve a more elaborate harness type system. In the preferred embodiment depicted engagement member 26 is of a sufficient width and is padded for comfort during performance of the swimming action.

A connection member will be provided to connect the engagement member contacting and retaining the swimmer to the multiple part pole. Various structural components may be utilized to perform this function. FIG. 1 depict connection member 28 having a first end 184 and a second end 186 with first end 184 secured relative to outer end 52 of multiple part pole 22 and second end 186 secured relative to engagement member 26. It is possible to provide for the connection member to be of a construction to have an elastic property to provide the resilient motion function of the present invention. In the preferred embodiment depicted connection member 28 is merely a conventional nylon strand braided cord.

An engagement member hanging hook member 188, see FIG. 3*a* and FIG. 3*b*, is positioned on multiple part pole 22 for hanging placement thereon of engagement member 26 of swimming exercise device 20 when not being utilized during performance of the swimming action. This arrangement provides for an orderly placement of the various components which prevents damage from being inflicted to any of the components while permitting full drying of the components, including engagement member 26 and connection member 28, following use.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a multiple part pole having at least two pole sections and at least one connection between the pole sections, the multiple part pole having a securing end, an outer end and a resilient flexibility along a portion of the multiple part pole at least near the outer end and wherein the pole sections further comprise an outermost section at the outer end of the multiple part pole when assembled and wherein the outermost section has a connection end and a terminal end and a reducing taper from the connection end to the terminal end and wherein the at least one connection between the pole sections of the multiple part pole further comprises a penetrate and securement coupling having a male member and a female member and wherein the pole sections associated with the connection slidably join utilizing the male member of the penetrate and securement coupling and the female member of the penetrate and securement coupling;

b) means to retain the securing end of the multiple part pole in a fixed position relative to the body of water;

c) an engagement member to contact the swimmer while leaving the swimmer free to manipulate their legs and arms during performance of the swimming action;

d) a connection member having a first end and a second end with the first end secured relative to the outer end of the multiple part pole and the second end secured relative to the engagement member;

wherein the multiple part pole, the engagement member and the connection member cooperate to provide for a restriction of placement of the swimmer in the body of water during the performance of the swimming action while further providing for a lifting action to the swimmer while in the body of water during the performance of the swimming action.

2. The swimming exercise device defined in claim 1 wherein each of the pole sections of the multiple part pole has a length measurement and wherein the length measurements of the pole sections are generally equal.

3. The swimming exercise device defined in claim 1 wherein the at least one connection between the pole sections of the multiple part pole further comprises:

a) a first threaded member; and b) a second threaded member;

and wherein member of the penetrate and securement coupling is securely retained in that orientation utilizing the first threaded member of the penetrate and securement coupling and the second threaded member of the penetrate and securement coupling.

4. The swimming exercise device defined in claim 3 wherein each of the pole sections associated with the connection further comprise a solid shaft material each having a coupling end and which are in extremely close orientation to each other when the penetrate and securement coupling is in a secured orientation.

5. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a multiple part pole having at least two pole sections and at least one connection between the pole sections, the multiple part pole having a securing end, an outer end and a resilient flexibility along a portion of the multiple part pole at least near the outer end and wherein the at least one connection between the pole sections of the multiple part pole further comprises an angular offset coupling wherein an orientation of a first pole section utilized by the connection is significantly altered angularly relative to an orientation of a second pole section utilized by the connection;

b) means to retain the securing end of the multiple part pole in a fixed position relative to the body of water;

c) an engagement member to contact the swimmer while leaving the swimmer free to manipulate their legs and arms during performance of the swimming action;

d) a connection member having a first end and a second end with the first end secured relative to the outer end of the multiple part pole and the second end secured relative to the engagement member;

wherein the multiple part pole, the engagement member and the connection member cooperate to provide for a restriction of placement of the swimmer in the body of water during the performance of the swimming action while further providing for a lifting action to the swimmer while in the body of water during the performance of the swimming action.

6. The swimming exercise device defined in claim 1 wherein each of the pole sections has a first diametric measurement and a second diametric measurement and wherein each first diametric measurement of each respective pole section is greater than the second diametric measurement of the respective pole section wherein a taper exists to the respective pole section.

7. The swimming exercise device defined in claim 1 wherein the pole section at the outer end of the multiple part pole has a first diametric measurement and a second diametric measurement and wherein the first diametric measurement is greater than the second diametric measurement wherein a taper exists to the pole section at the outer end of the multiple part pole.

8. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a multiple part pole having at least two pole sections and at least one connection between the pole sections, the multiple part pole having a securing end, an outer end and a resilient flexibility along a portion of the multiple part pole at least near the outer end and wherein the at least one connection between the pole sections of the multiple part pole further comprises a securement coupling having a first threaded member and a second threaded member and wherein the pole sections associated with the connection join and are securely retained in that orientation utilizing the first threaded member of the securement coupling and the second threaded member of the securement coupling;

b) means to retain the securing end of the multiple part pole in a fixed position relative to the body of water;

c) an engagement member to contact the swimmer while leaving the swimmer free to manipulate their legs and arms during performance of the swimming action;

d) a connection member having a first end and a second end with the first end secured relative to the outer end of the multiple part pole and the second end secured relative to the engagement member;

wherein the multiple part pole, the engagement member and the connection member cooperate to provide for a restriction of placement of the swimmer in the body of water during the performance of the swimming action while further providing for a lifting action to the swimmer while in the body of water during the performance of the swimming action.

9. The swimming exercise device defined in claim 8 wherein the multiple part pole has two pole sections and one connection.

10. The swimming exercise device defined in claim 8 wherein the multiple part pole has three pole sections and two connections.

11. The swimming exercise device defined in claim 10 wherein the two connections have identical measurements.

12. The swimming exercise device defined in claim 10 wherein the three pole sections further comprise a securing end pole section associated with the securing end of the multiple part pole and an outer end pole section associated with the outer end of the multiple part pole and an intermediate pole section positioned between the securing end pole section and the outer end pole section and wherein the intermediate pole section has a first diametric measurement and a second diametric measurement and wherein the first diametric measurement is greater than the second diametric measurement wherein a taper exists to the intermediate pole section of the multiple part pole.

13. The swimming exercise device defined in claim 8 wherein the securement coupling further comprises a male member and a female member and wherein the pole sections associated with the connection slidably join utilizing the male member of the securement coupling and the female member of the securement coupling and are securely retained in that orientation utilizing the first threaded member of the securement coupling and the second threaded member of the securement coupling.

14. The swimming exercise device defined in claim 13 wherein each of the pole sections associated with the connection further comprise a solid shaft material each having a coupling end and which are in extremely close orientation to each other when the securement coupling is in a secured orientation.

15. The swimming exercise device defined in claim 8 wherein the at least one connection between the pole sections of the multiple part pole further comprises an angular offset coupling wherein an orientation of a first pole section utilized by the connection is significantly altered of a second pole section utilized by the connection.

16. The swimming exercise device defined in claim 15 wherein the angular offset coupling further comprises opposing penetrate couplings to engage the pole sections utilized by the connection.

17. The swimming exercise device defined in claim 8 wherein each of the pole sections has a first diametric measurement and a second diametric measurement and wherein each first diametric measurement of each respective pole section is greater than the second diametric measurement of the respective pole section wherein a taper exists to the respective pole section.

18. The swimming exercise device defined in claim 5 wherein the angular offset coupling further comprises opposing penetrate couplings to engage the pole sections utilized by the connection.

* * * * *